US005806680A

United States Patent [19]

Barthel et al.

[11] Patent Number: 5,806,680

[45] Date of Patent: Sep. 15, 1998

[54] PROCESS FOR FILLING PACKAGES WITH TABLET-SHAPED PRODUCTS AND RESULTING

[75] Inventors: Wolfgang Barthel, Duesseldorf; Werner Kuenzel, Langenfeld; Hubert Droessler, Erkrath; Monika Schmitt, Duesseldorf; Klaus Meyer, Neuss; Stefan Huchler, Leverkusen, all of Germany

[73] Assignee: Henkel Kommanditgesellschaft auf Aktien, Duesseldorf, Germany

[21] Appl. No.: 776,785

[22] PCT Filed: Aug. 3, 1995

[86] PCT No.: PCT/EP95/03093

§ 371 Date: Mar. 10, 1997

§ 102(e) Date: Mar. 10, 1997

[87] PCT Pub. No.: WO96/05105

PCT Pub. Date: Feb. 22, 1996

[30] Foreign Application Priority Data

Aug. 11, 1994 [DE] Germany ..... 44 28 472.1

[51] Int. Cl.[6] ..... B65D 85/62

[52] U.S. Cl. ..... 206/499; 206/526; 53/439; 53/458; 53/475

[58] Field of Search ..... 206/427, 434, 206/446, 443, 497, 499, 526; 53/458, 457, 439, 475

[56] References Cited

U.S. PATENT DOCUMENTS

| | | | |
|---|---|---|---|
| 2,001,478 | 5/1935 | Voght | 206/499 |
| 2,005,545 | 6/1935 | Hulbert | 93/6 |
| 2,788,894 | 4/1957 | Shifrer | 206/446 |
| 3,014,321 | 12/1961 | Lesch | 53/195 |
| 3,302,843 | 2/1967 | Sheehan | 206/499 |
| 3,808,766 | 5/1974 | Hutchinson et al. | 53/475 |
| 3,998,379 | 12/1976 | Myers et al. | 206/446 |
| 4,662,150 | 5/1987 | Johnson et al. | 53/458 |
| 4,880,115 | 11/1989 | Chaussadas | 206/434 |
| 4,919,266 | 4/1990 | McIntosh, Jr. et al. | 206/434 |

FOREIGN PATENT DOCUMENTS

| | | |
|---|---|---|
| 580 131 | 7/1933 | Germany . |
| 11 17 473 | 11/1961 | Germany . |
| 11 85 983 | 1/1965 | Germany . |
| 21 23 991 | 8/1972 | Germany . |
| 415 437 | 1/1967 | Switzerland . |
| 703 364 | 2/1954 | United Kingdom . |

*Primary Examiner*—David T. Fidei
*Attorney, Agent, or Firm*—Ernest G. Szoke; Wayne C. Jaeschke; Real J. Grandmaison

[57] ABSTRACT

A process for filling a non-self-supporting pack with cylindrical, pellet-like products by introducing into a pack closely surrounding at least one multiple-row layer of the products in such a manner that the products are arranged beside and above one another in linear contact with one another at their cylindrical surfaces and are arranged closely adjacent one another in the pack so that they fit exactly into the pack, are self-supporting, and disperse a pressure applied externally to the pack through the cylindrical surfaces of the products. The pack is brought into a transportation position wherein the products are in an upright position. A pack unit of the products is also disclosed.

7 Claims, 1 Drawing Sheet

PROCESS FOR FILLING PACKAGES WITH TABLET-SHAPED PRODUCTS AND RESULTING

This application is a 35 U.S.C. § 371 application of PCT/EP95/03093 filed Aug. 3, 1996.

BACKGROUND OF THE INVENTION

1. Field of Invention

This invention relates to a process for filling a pack with pellet-like products, more particularly detergent or cleaning pellets, and to a corresponding pack unit.

2. Discussion of Related Art

It is known that powder-form detergents or cleaners can be converted into portioned pellets by application of external pressure to the powder in the mold. Corresponding detergent or cleaning pellets are often made in cylindrical form. The surface of each cylinder is highly compacted and smooth. The diameter of such pellets has only minimal tolerances and any variations in the density of the powder product and in the pressure applied are generally reflected in only slight variations in height.

Hitherto, pellet-like products of the type in question have been loosely packed in self-supporting folding boxes and the like, for example rectangular drums.

A disadvantage of the known process is that the packing density achieved is very low on account of the loose filling. Packaging costs are high in relation to pack content. A large amount of air is packed between the individual pellets. This means that packaging, transportation and storage costs are unnecessarily high. Another major disadvantage is that, during their packaging, transportation and storage, loose pellet-like products rub heavily against one another and can break at their edges.

The problem addressed by the present invention was to provide a process which would significantly reduce packaging, transportation and storage costs and which would avoid damage to the pellet-like products.

DESCRIPTION OF THE INVENTION

According to the invention, this process is characterized in that the pellet-like products are introduced into the pack in an ordered manner.

The process according to the invention avoids disorder, frequent edge breakage and product abrasion. After conversion from a powder-form product into a pellet-like product, the pellets are arranged and introduced into the pack in an ordered manner, their free surface in the pack and hence air spaces between pellets being distinctly reduced.

In one advantageous embodiment of the invention, the pellet-like products are introduced into the pack in such a way that pellet-like products arranged beside and over one another are in linear contact with one another at their cylindrical surfaces. This has the advantage that the pellets are self-supporting in the upright position and that the flow of force under an external load, for example the stack pressure where packs are stacked one above the other, is transmitted through the cylindrical surfaces. Accordingly, by virtue of their exact and uniform diameter, the pellets all support one another in the pack and the pressure applied to each individual pellet is minimal. In addition, troublesome product abrasion and edge breakage are largely eliminated by the linear contact between pellets at their cylindrical surfaces.

In another advantageous embodiment of the invention, the pellet-like products are introduced into the pack in at least one row and at least one layer. Pack size can be varied in this way. Any number of pellets may be arranged beside or over one another. Depending on the diameter and height of the pellets, there are preferably so many rows and layers that the pack surrounding them has the external dimensions required for a module. It has been found that the ordered arrangement of the pellets provides for a considerable increase in packing density over the hitherto known loose filling of around 50% so that the amount of air packed between pellets is considerably reduced.

If a multiple-row arrangement is selected, the free surface of the pellets is further reduced so that product protection is further improved.

Another advantageous embodiment of the invention is characterized in that at least one multiple-row layer of closely adjacent pellet-like products in linear contact with one another at their cylindrical surfaces is introduced into a pack closely surrounding the at least one layer. Besides the advantages already mentioned, this ensures that the pellet-like products are unable to slide back and forth, thus guaranteeing very high stability of the pack and its contents.

In another advantageous embodiment of the invention, a non-self-supporting pack may also be used in the process according to the invention. In this case, the pellet-like products held together by the surrounding pack are self-supporting. Packaging costs can thus be minimized, the pellet-like products requiring only a light outer wrapping.

The process according to the invention may advantageously be carried out by introducing at least one layer and row of pellets lying on its front end into an erected pack through an opened flap side with the aid of a pusher, gluing the pack and bringing it into the transportation position by turning through 90°. To this end, a pack, for example a longitudinally glued box blank, is first erected and the pellet-like products are introduced into the stable horizontal layer through the opened flap side. The flaps are then glued and, for transportation, the pack is brought into the transportation position by turning through 90°. In this position, the pellet-like products are arranged in such a way that a load acting externally on the pack, for example stack pressure, is transmitted through the cylindrical surfaces and the pellets in the pack are self-supporting.

Alternatively, a flat, i.e. non-erected, box blank may be covered with at least one layer of pellets and then closed and glued so that it surrounds the at least one layer of pellets. This is known as the wrap-around technique.

In another alternative embodiment, a flat, i.e. non-erected, box blank is first partly erected by gluing its top and/or bottom dust laps in such a way that the largest opening—now situated on top—acts as a pellet-receiving compartment, at least one layer of pellets is introduced into this compartment and the pack is closed so that it surrounds the at least one layer of pellets. The layer of pellets may be introduced, for example, by a robot arm.

The present invention also relates to a pack unit comprising a pack and pellet-like products, more particularly cylindrical detergent or cleaning pellets, arranged therein, in which the pellet-like products are arranged in the pack by the process according to the invention or one of its variants. A pack unit according to the invention contains the pellet-like products packed in accordance with the invention. By virtue of the exact fit of the pack unit which closely surrounds at least one layer and row of pellets, effective product protection is achieved for minimized packaging, transportation and storage costs.

BRIEF DESCRIPTION OF THE DRAWINGS

The invention is described by way of example in the following with reference to the accompanying drawings, wherein.

DETAILED DESCRIPTION OF THE DRAWINGS

Figure 1:
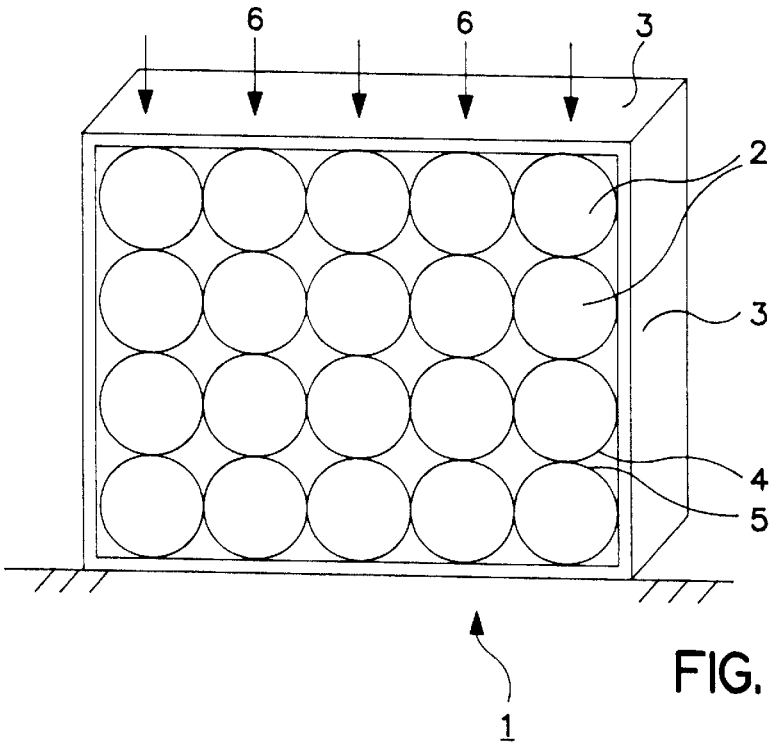
FIG. 1 is a lateral view showing an ordered layer of pellets surrounded by a pack—shown in part only—with linear contact between the cylindrical surfaces in the transportation position.

Of a pack unit 1 comprising a pack and pellet-like products arranged therein, FIG. 1 shows only one multiple-row layer of pellet-like products 2 and—in places—the narrow sides of a pack 3 surrounding them in the transportation position.

The pellet-like products 2 arranged in several rows (both beside and above one another) are in linear contact with one another at their cylindrical surfaces 4 in the zones 5. If a pressure, for example stack pressure 6, is applied to the outside of the pack, the flow of force is transmitted and dispersed through the cylindrical surfaces 4 of the pellet-like products 2. In this way, the pressure applied to each individual pellet is minimal, the pellets being self-supporting so that the pack 3 does not have to be self-supporting.

Figure 2:
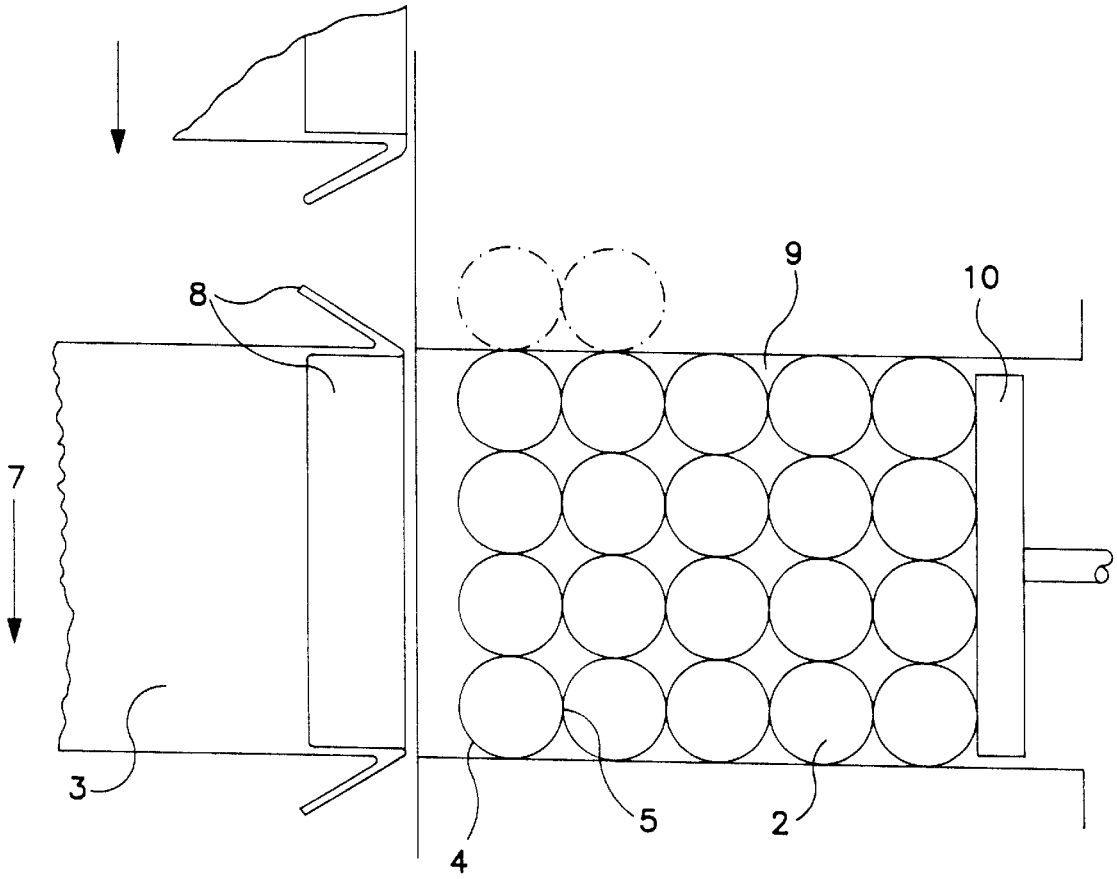
FIG. 2 is a plan view of an ordered layer of pellets lying on its front end with a pusher for pushing the pellets into an erected pack—shown in part only—with an opened flap side.

An advantageous process for the ordered filling of a pack 3 with pellet-like products 2 is shown in simplified form in FIG. 2. An erected pack 3, for example a longitudinally glued box blank, with an opened flap side 8 is delivered on one feed plane 7. A multiple-row layer of pellet-like products 2 lying on its front end is delivered on another feed plane 9 and introduced into the correspondingly positioned pack 3 by means of a pusher 10. The pack 3 is further conveyed on the plane 7, glued (not shown) and turned through 90° into the transportation position shown in FIG. 1.

The invention is not of course confined to the embodiments illustrated in the drawing. Other variants of the invention are possible without departing from the basic concept. For example, non-cylindrical pellet-like products, for example square, hexagonal or octagonal pellets, may be introduced into a pack in an ordered manner. Besides a traditional box, the pack may assume any other suitable form. In order to meet commercial requirements, the external dimensions should correspond to those of a module which can be achieved by correspondingly dimensioning the useful inner space of the pellet pack. To enable the pellets to be readily removed from the pack, the pack is best opened via its upper largest face while the pack unit lies in the ready-to-use position on its opposite largest face which guarantees the best possible stability.

To meet particularly stringent product protection requirements, the pellet-like products may be individually packaged, for example in a hermetically sealed paper or foil wrapping.

I claim:

1. The process of filling a non-self-supporting pack with cylindrical detergent pellets comprising introducing into a pack closely surrounding at least one multiple-row layer of said pellets in such a manner that said pellets are arranged beside and above one another in linear contact with one another at their cylindrical surfaces and are arranged closely adjacent one another in said pack so that they fit exactly into said pack, are self-supporting, and disperse a pressure applied externally to said pack through the cylindrical surfaces of said pellets, and bringing said pack into a transportation position wherein said pellets are in an upright position.

2. A process as in claim 1 wherein said non-self-supporting pack comprises a flat, non-erected, box blank, said pack is covered with at least one multiple row layer of said detergent pellets, and said pack is then closed so that it surrounds said layer of said detergent pellets.

3. A process as in claim 2 wherein said flat, non-erected box blank is first partly erected by gluing its top or bottom flaps so that the largest opening of said box blank is located at its top portion and is a product-receiving compartment, introducing at least one multiple-row layer of said detergent pellets into said compartment, and closing the pack so that it surrounds said layer of said detergent pellets.

4. A pack unit prepared from a non-self-supporting pack containing cylindrical detergent pellets which have been introduced into a pack closely surrounding at least one multiple-row layer of said detergent pellets in such a manner that said detergent pellets are arranged beside and above one another in linear contact with one another at their cylindrical surfaces and are arranged closely adjacent one another in said pack so that they fit exactly into said pack, are self-supporting, and disperse a pressure applied externally to said pack through the cylindrical surfaces of said detergent pellets, said pack having been brought into a transportation position wherein said detergent pellets are in an upright position.

5. A pack unit as in claim 4 wherein said non-self-supporting pack comprises a flat, non-erected, box blank, said pack has been covered with at least one multiple-row layer of said detergent pellets, and said pack is closed so that it surrounds said layer of said detergent pellets.

6. A pack unit as in claim 5 wherein said flat, non-erected box blank has been first partly erected by gluing its top or bottom flaps so that the largest opening of said box blank is located at its top portion and is a product-receiving compartment, at least one multiple-row layer of said detergent pellets has been introduced into said compartment, and said pack has been closed so that it surrounds said layer of said detergent pellets.

7. A process as in claim 3 wherein said detergent tablets are introduced into said product-receiving compartment by a pusher device.

* * * * *